US012433423B2

(12) United States Patent
Beeravolu

(10) Patent No.: US 12,433,423 B2
(45) Date of Patent: Oct. 7, 2025

(54) EXTENDABLE FURNITURE COVERING SYSTEM

(71) Applicant: Sudhamshu Beeravolu, Rancho Mission Viejo, CA (US)

(72) Inventor: Sudhamshu Beeravolu, Rancho Mission Viejo, CA (US)

( * ) Notice: Subject to any disclaimer, the term of this patent is extended or adjusted under 35 U.S.C. 154(b) by 200 days.

(21) Appl. No.: 18/117,813

(22) Filed: Mar. 6, 2023

(65) Prior Publication Data

US 2024/0298814 A1 Sep. 12, 2024

(51) Int. Cl.
*A47C 31/11* (2006.01)

(52) U.S. Cl.
CPC ..... *A47C 31/11* (2013.01)

(58) Field of Classification Search
CPC ..... A47C 31/11
See application file for complete search history.

(56) References Cited

U.S. PATENT DOCUMENTS 4,131,312 A 12/1978 Price
5,000,210 A * 3/1991 Worthington, Jr. ..... A47C 7/66 135/96
5,015,032 A 5/1991 Felling
5,833,310 A 11/1998 Labelle
5,967,601 A * 10/1999 Gillins ..... A47C 7/66 135/96
7,594,695 B2 9/2009 Noonan
7,861,735 B2 * 1/2011 Stepaniuk ..... A61G 5/10 135/96
D785,382 S 5/2017 Bosket, Sr.
11,850,193 B2 * 12/2023 Wooden ..... B62B 5/0013
2017/0164742 A1 6/2017 Hay
2019/0106902 A1 * 4/2019 Irizarry ..... B60J 11/04
2019/0133336 A1 5/2019 Ennis
2021/0219680 A1 7/2021 Amin

FOREIGN PATENT DOCUMENTS

KR 20220164173 A * 12/2022

* cited by examiner

*Primary Examiner* — Tri M Mai

(57) ABSTRACT

An extendable furniture covering system protecting a chair from accumulating water includes a chair and a covering being couplable to the chair and being positionable from a closed position wherein the covering does not cover the chair to an open position wherein the covering covers the chair. The covering includes a frame including a pair of vertical arms extending between a lower cross member and an upper cross member. A pair of hubs is coupled to the frame on opposite sides of the lower cross member and a plurality of ribs is pivotally coupled to and extends between the hubs. A canopy is coupled to the ribs such that the canopy is extendable from the closed position to the open position. The canopy is liquid impermeable, wherein the canopy prevents the chair from accumulating liquid.

9 Claims, 7 Drawing Sheets

EXTENDABLE FURNITURE COVERING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to furniture covers and more particularly pertains to a new furniture cover for protecting a chair from accumulating water.

(2) Description of Related Art Including Information Disclosed Under 37 CFR 1.97 and 1.98

The prior art relates to furniture covers and includes a variety of furniture covers being deployable into a covering position to cover furniture. Known prior art does not allow a furniture cover having a furniture cover being coupled to a chair and including a canopy being water proof to protect the chair from accumulating water when the furniture cover is deployed into a covering position.

BRIEF SUMMARY OF THE INVENTION

An embodiment of the disclosure meets the needs presented above by generally comprising a chair and a covering being couplable to the chair and being positionable from a closed position wherein the covering does not cover the chair to an open position wherein the covering covers the chair. The covering includes a frame including a pair of vertical arms extending between a lower cross member and an upper cross member. A pair of hubs is coupled to the frame on opposite sides of the lower cross member and a plurality of ribs is pivotally coupled to and extends between the hubs. A canopy is coupled to the ribs such that the canopy is extendable from the closed position to the open position. The canopy is liquid impermeable, wherein the canopy prevents the chair from accumulating liquid.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
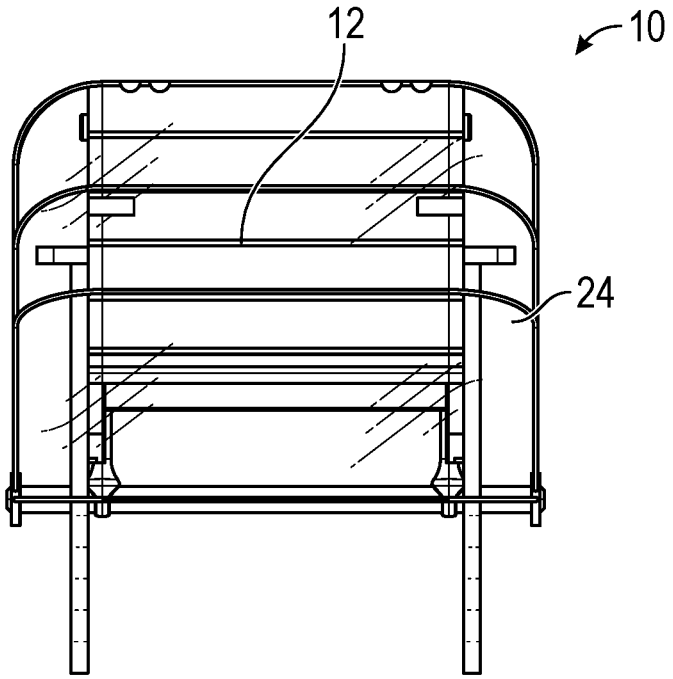
FIG. 1 is a front view of an extendable furniture covering system according to an embodiment of the disclosure.
Figure 2:
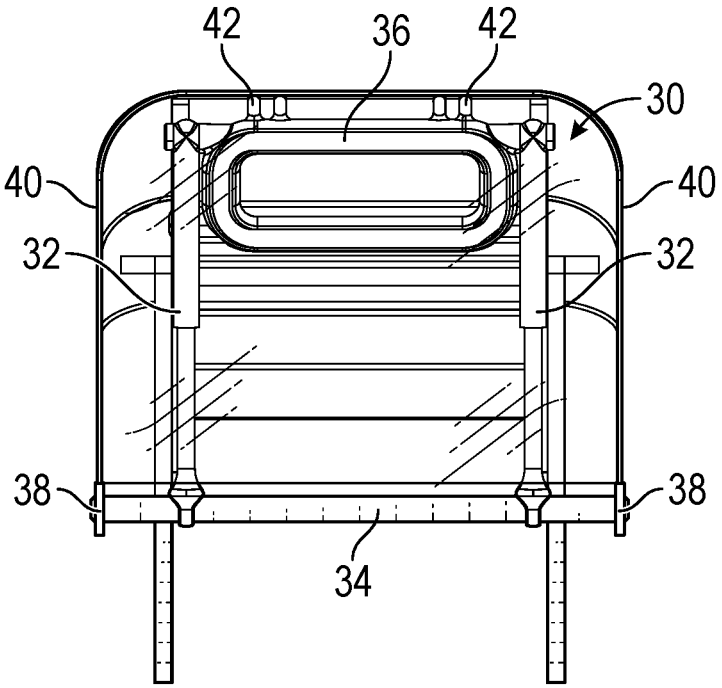
FIG. 2 is a back view of an embodiment of the disclosure.
Figure 3:
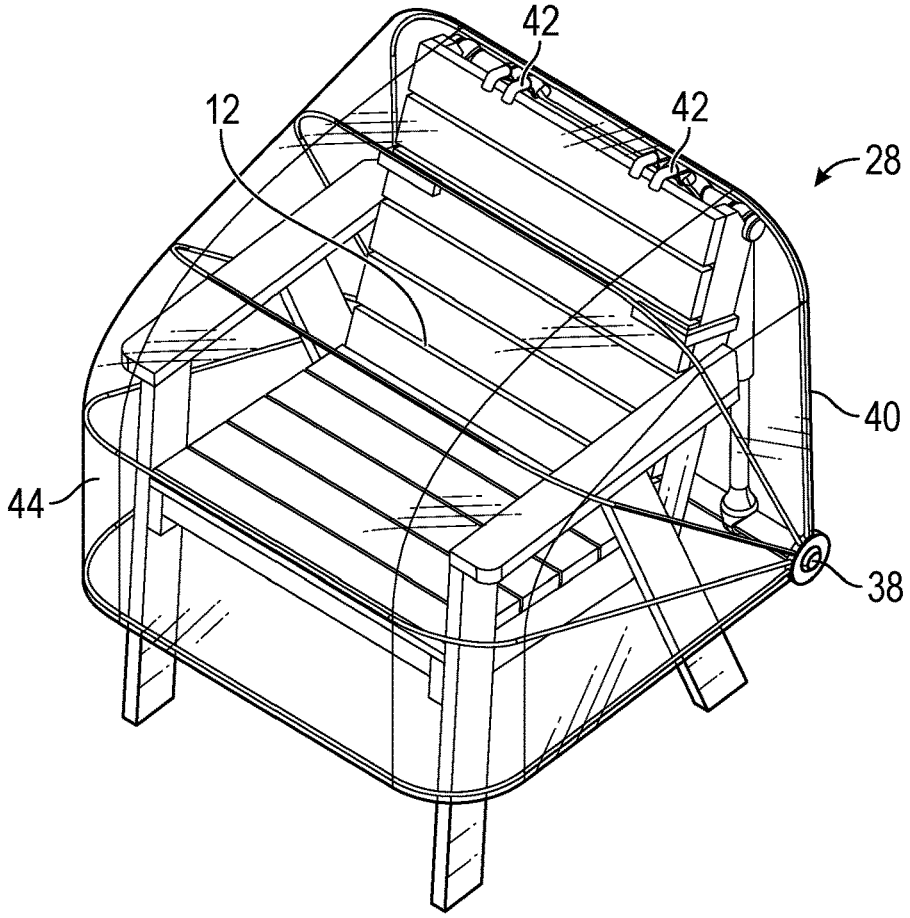
FIG. 3 is a top isometric closed view of an embodiment of the disclosure.
Figure 4:
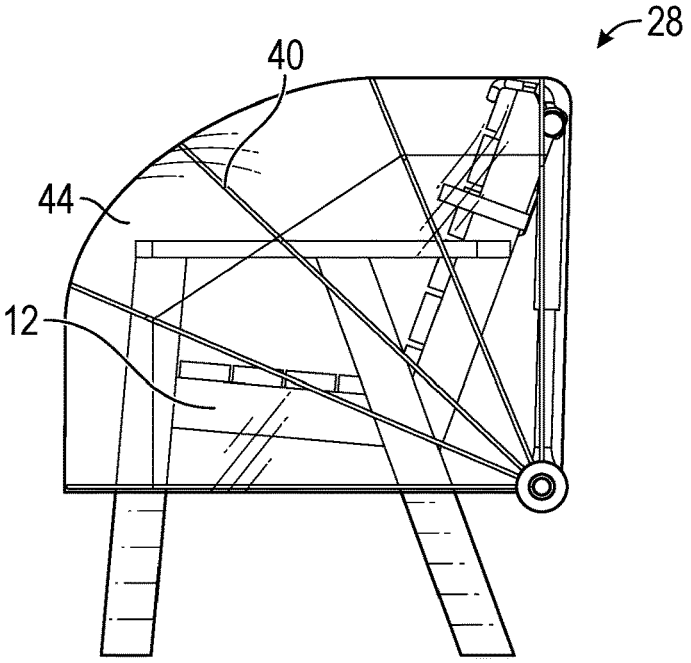
FIG. 4 is a right-side closed view of an embodiment of the disclosure.
Figure 5:
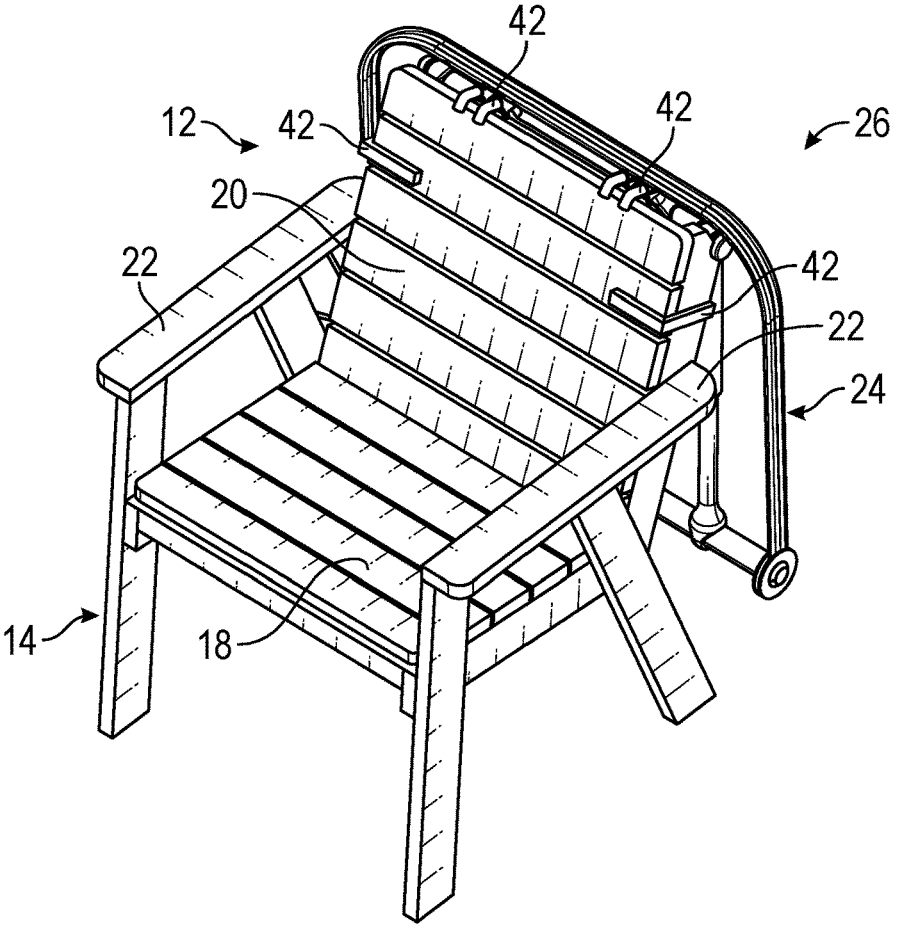
FIG. 5 is a top isometric open view of an embodiment of the disclosure.
Figure 6:
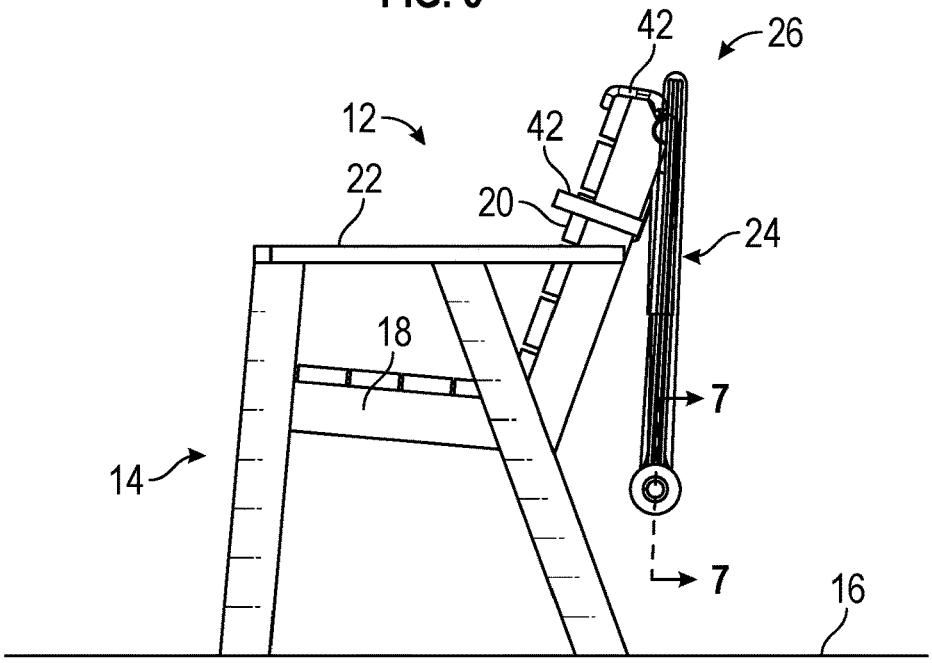
FIG. 6 is a right-side open view of an embodiment of the disclosure.
Figure 7:
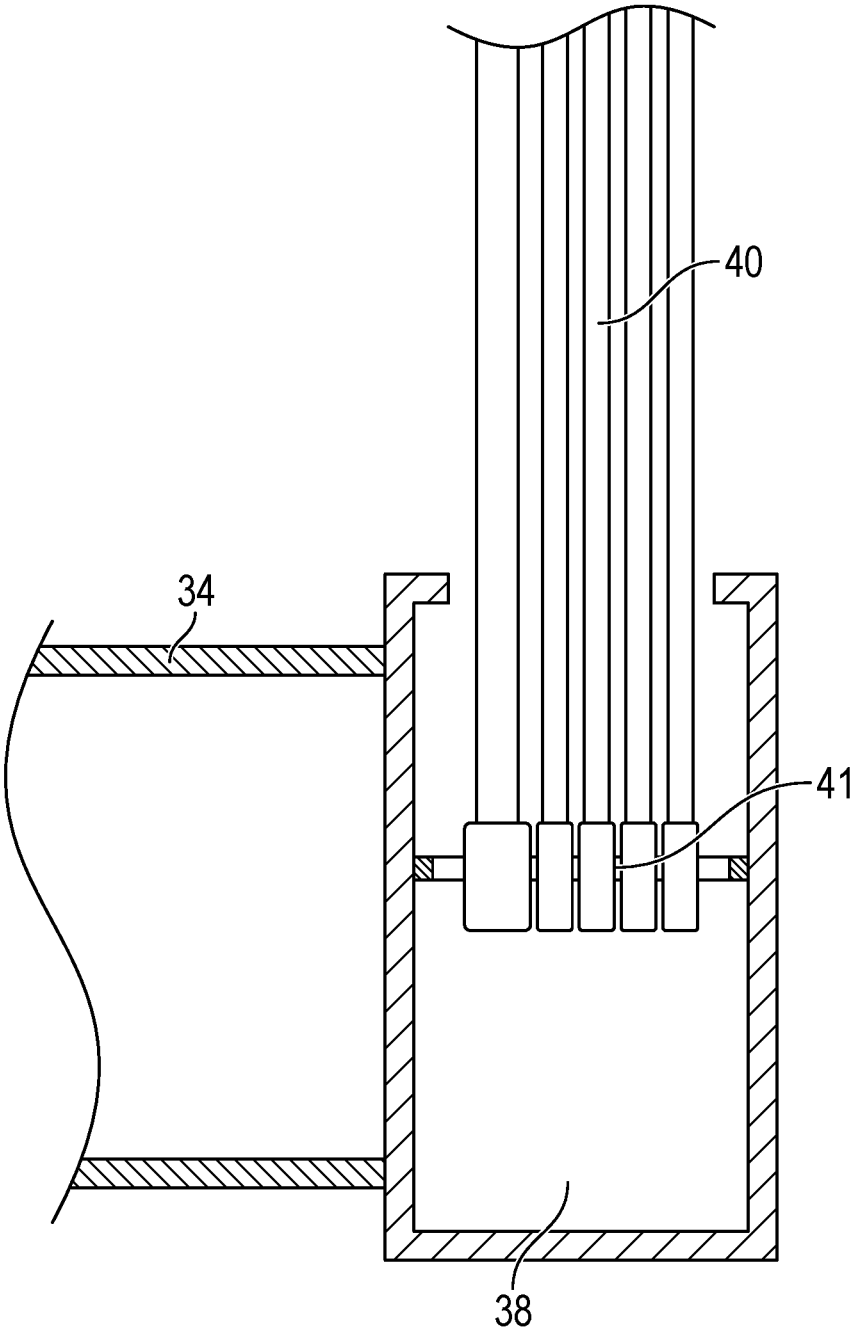
FIG. 7 is a cross-sectional view of an embodiment of the disclosure taken along Line 7-7 of FIG. 6.
Figure 8:
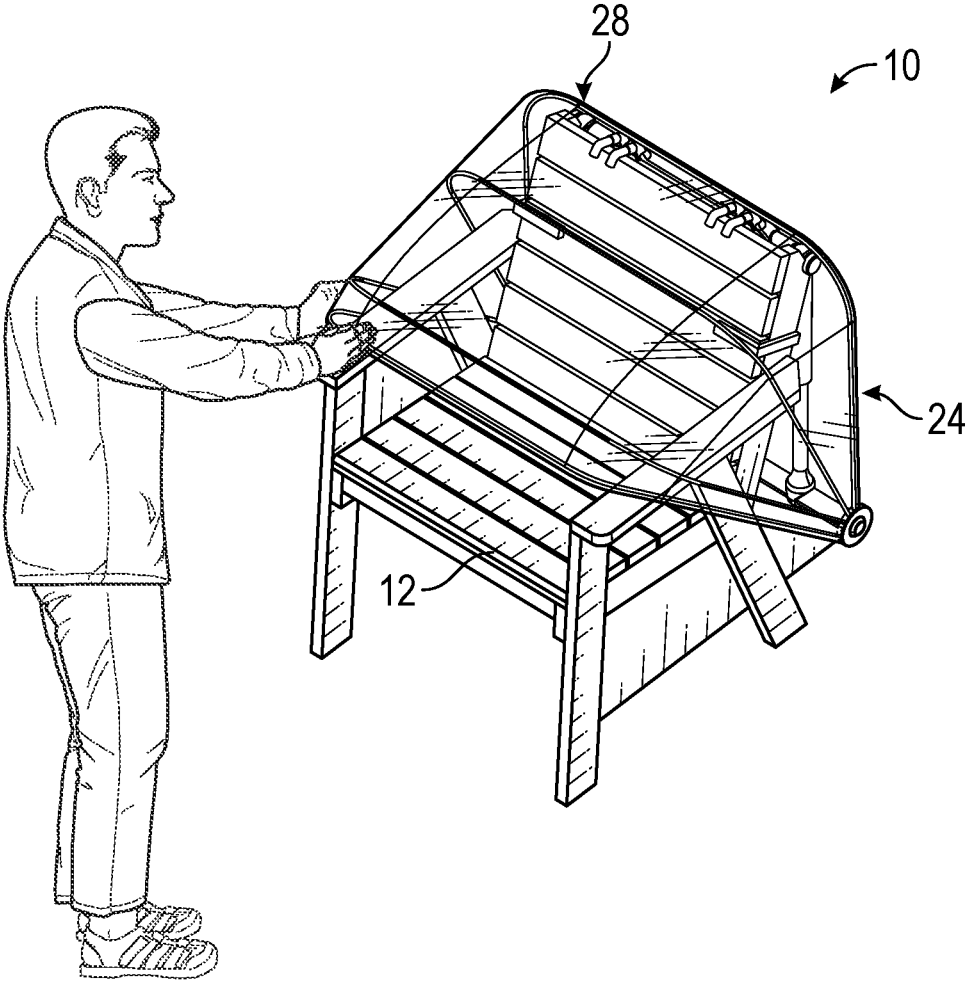
FIG. 8 is an in-use view of an embodiment of the disclosure.
Figure 9:
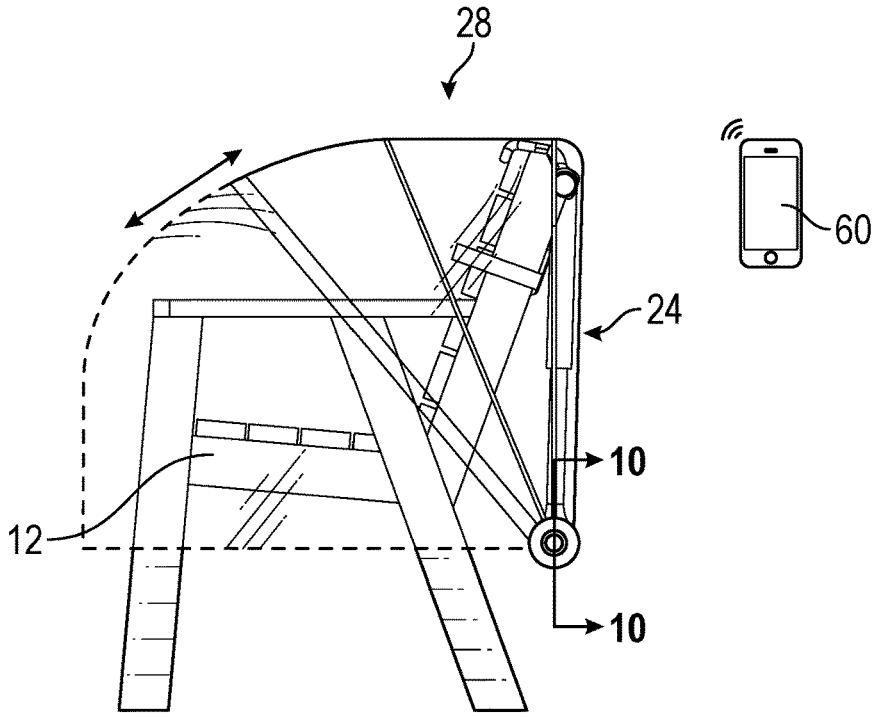
FIG. 9 is a right-side open view of an alternative embodiment of the disclosure.
Figure 10:
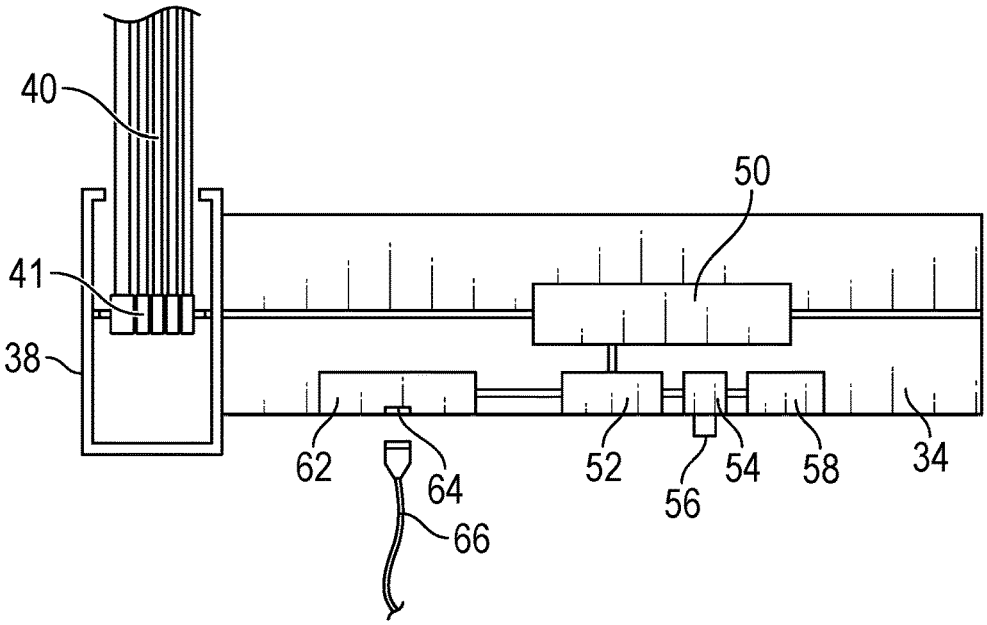
FIG. 10 is a cross-sectional view of an alternative embodiment of the disclosure taken along Line 10-10 of FIG. 9.
Figure 11:
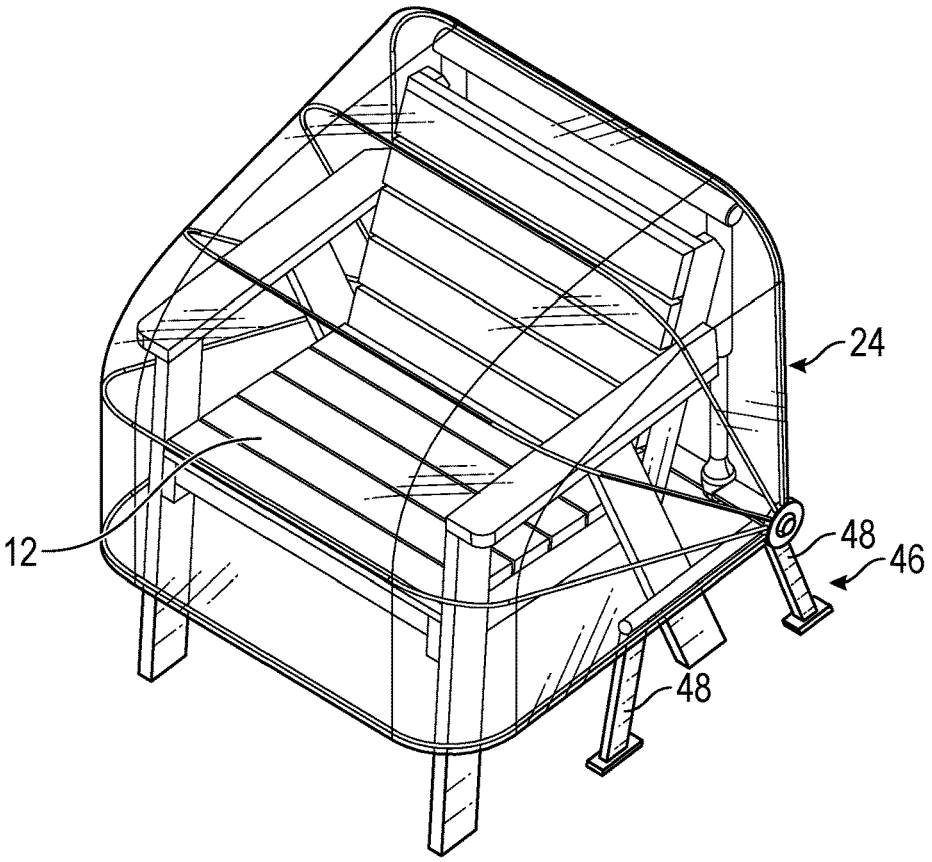
FIG. 11 is a top isometric view of an alternative embodiment of the disclosure.
Figure 12:
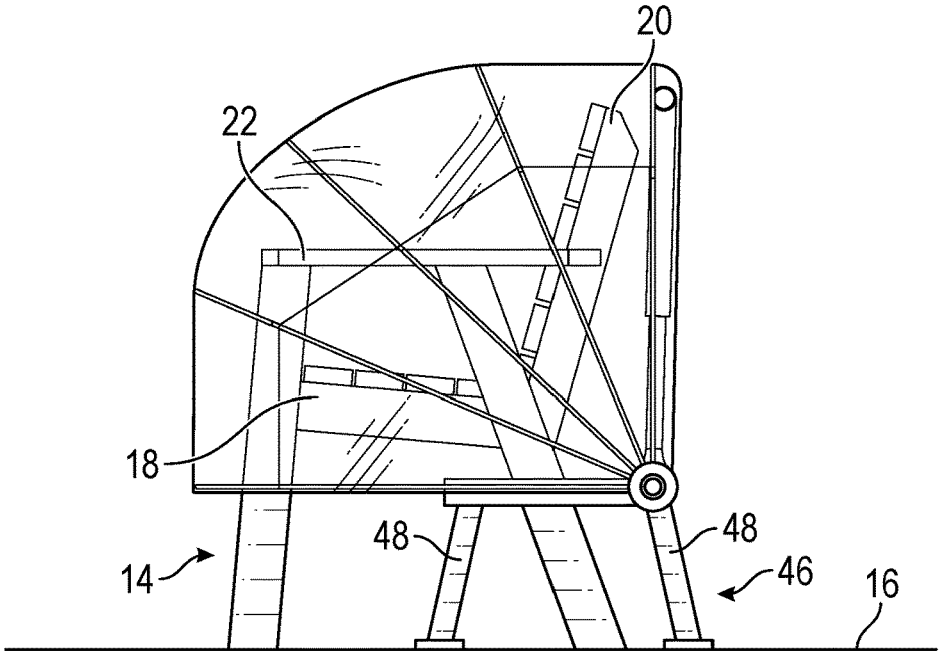
FIG. 12 is a right-side closed view of an alternative embodiment of the disclosure.

With reference now to the drawings, and in particular to FIGS. 1 through 13 thereof, a new furniture cover embodying the principles and concepts of an embodiment of the disclosure and generally designated by the reference numeral 10 will be described.

As best illustrated in FIGS. 1 through 13, the extendable furniture covering 24 system 10 generally comprises a chair 12. The chair 12 typically includes a plurality of legs 14 configured for standing on a ground surface 16. A seat 18 is coupled to the plurality of legs 14 and a backrest 20 is normally coupled to a rear of the seat 18. A pair of arms 22 may be coupled to the backrest 20 and extend forward therefrom. A covering 24 is couplable to the chair 12 and is positionable from a closed position 26 wherein the covering 24 does not cover the chair 12 to an open position 28 wherein the covering 24 covers the chair 12.

The covering 24 normally includes a frame 30 including a pair of vertical arms 32 extending between a lower cross member 34 and an upper cross member 36. A pair of hubs 38 is coupled to the frame 30 on opposite sides of the lower cross member 34 and a plurality of ribs 40 is pivotally coupled to and extends between the hubs 38. Each rib 40 normally extends upwardly from the hubs 38 over a top of the chair 12. Each of the hubs 38 will typically have a pivot 41 being coupled to the plurality of ribs 40. A plurality of hooks 42 is coupled to the upper cross member 36 and are removably mountable to the backrest 20 of the chair 12, wherein the covering 24 is removably mountable to the chair 12.

A canopy 44 is coupled to the ribs 40 such that the canopy 44 is extendable from the closed position 26 to the open position 28. The canopy 44 may be collapsed between the plurality of ribs 40 of the frame 30 in the closed position 26 and the canopy 44 may be extended between the plurality of ribs 40 in the open position 28. The canopy 44 is normally liquid impermeable, wherein the canopy 44 prevents the chair 12 from accumulating liquid such as rainwater or snow.

A stand 46 may be coupled to the covering 24 and may be configured for standing the covering 24 in an upright position on the ground surface 16, wherein the covering 24 may be positioned in the upright position proximate to the chair 12. The stand 46 may be positionable proximate to the legs 14 and to the backrest 20 of the chair 12. The stand 46 may comprise a plurality of vertical supports 48 being coupled to the lower cross member 34 of the frame 30 of the covering 24 and extending downwardly therefrom.

A motor 50 may be mechanically coupled with the covering 24 and may be configured for positioning the covering 24 from the closed position 26 to the open position 28 when actuated. The motor 50 may be mechanically coupled to the pivot 41 of the plurality of ribs 40 of the frame 30 and be actuated to pivotally position the ribs 40 from the closed position 26 to the open position 28. The motor 50 may be positioned within the lower cross member 34. A control circuit 52 may be electrically coupled to the motor 50 and may be positioned within the lower cross member 34. An actuator 54 may be electrically coupled with the control circuit 52 and may be actuated to start or stop motor 50. The actuator 54 may include a switch 56 being mounted on an exterior of the lower cross member 34.

A transceiver 58 may be electrically coupled to the control circuit 52 and may be configured for wirelessly communicating with a personal electronic device 60, wherein the personal electronic device 60 is in wireless communication with the actuator 54. A user may engage with the personal electronic device 60 to wirelessly communicate with the actuator 54 to start or stop the motor 50. The transceiver 58 may be positioned within the lower cross member 34. A battery 62 may be electrically coupled to the control circuit 52 and may be positioned within the lower cross member 34. The battery 62 may be rechargeable and may have a charging port 64 configured for removably receiving a charging cord 66 of a power supply. The charging port 64 may be typically positioned on the exterior surface of the lower cross member 34.

In use, the plurality of hooks 42 the frame 30 of the covering 24 may be mounted to the backrest 20 of the chair 12 or the stand 46 of the covering 24 may stand the covering 24 in the upright position proximate to the chair 12. The covering 24 may be positioned from the closed position 26 to the open position 28 by manually pulling on the plurality of ribs 40 of the frame 30 to extend the canopy 44 over the chair 12, or the covering 24 may be positioned from the closed position 26 to the open position 28 by actuating the motor 50 to mechanically pivot the plurality of ribs 40 into the open position 28.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An extendable covering system comprising:

a chair, wherein said chair includes a plurality of legs configured for standing on a ground surface, a seat being coupled to said plurality of legs, and a backrest being coupled to a rear of said seat;

a covering being couplable to said chair and being positionable from a closed position wherein said covering does not cover said chair to an open position wherein said covering covers and encloses said chair, said covering including a frame including a pair of vertical arms extending between a lower cross member and an upper cross member, a pair of hubs being coupled to said frame on opposite sides of said lower cross member, a plurality of ribs being pivotally coupled to and extending between said hubs, and a canopy being coupled to said ribs such that the canopy is extendable from said closed position to said open position, said canopy being liquid impermeable, wherein said canopy prevents said chair from accumulating liquid; and wherein each rib extends upwardly from said hubs over a top of said chair, a plurality of hooks being coupled to and linearly aligned along said upper cross member, said hooks being removably mountable to said backrest of said chair, wherein said covering is removably mountable to said chair, said canopy extending forwardly and downwardly from said hooks when said canopy is in said open position wherein said canopy encloses said backrest, said seat, and a top portion of said plurality of legs when said canopy is in said open position.

2. The extendable covering system of claim 1, further including a pair of arms being coupled to said backrest and extending forward therefrom.

3. The extendable covering system of claim 2, wherein said canopy is collapsed between said plurality of ribs of said frame in said closed position, said canopy being extended between said plurality of ribs in said open position.

4. The extendable covering system of claim 1, further including a motor being mechanically coupled with said covering and being configured for positioning said covering from said closed position to said open position when actuated, said motor being mechanically coupled said plurality of ribs of said frame, said motor being actuated to pivotally position said ribs from said closed position to said open position, said motor being positioned within said lower cross member.

5. The extendable covering system of claim 4, further including a control circuit being electrically coupled to said motor, said control circuit being positioned within said lower cross member.

6. The extendable covering system of claim 5, further including an actuator being electrically coupled with said control circuit, said actuator being actuated to start or stop said motor.

7. The extendable covering system of claim 6, further including a transceiver being electrically coupled to said control circuit, said transceiver being configured for wirelessly communicating with a personal electronic device, wherein the personal electronic device is in wireless communication with said actuator, said transceiver being positioned within said lower cross member.

8. The extendable covering system of claim 7, further including a battery being electrically coupled to said control circuit, said battery being positioned within said lower cross member, said battery being rechargeable, said battery having a charging port configured for removably receiving a charging cord of a power supply, said charging port being positioned on an exterior surface of said lower cross member.

9. An extendable covering system comprising:

a chair, said chair including:

a plurality of legs configured for standing on a ground surface;

a seat being coupled to said plurality of legs;

a backrest being coupled to a rear of said seat; and a pair of arms being coupled to said backrest and extending forward therefrom;

a covering being couplable to said chair and being positionable from a closed position wherein said covering does not cover said chair to an open position wherein said covering covers said chair, said covering including:

a frame including a pair of vertical arms extending between a lower cross member and an upper cross member, a pair of hubs being coupled to said frame on opposite sides of said lower cross member, a plurality of ribs being pivotally coupled to and extending between said hubs, each rib extending upwardly from said hubs over a top of said chair, a plurality of hooks being coupled to and linearly aligned along said upper cross member, said hooks being removably mountable to said backrest of said chair, wherein said covering is removably mountable to said chair; and a canopy being coupled to said ribs such that the canopy is extendable from said closed position to said open position, said canopy being collapsed between said plurality of ribs of said frame in said closed position, said canopy being extended between said plurality of ribs in said open position, said canopy being liquid impermeable, wherein said canopy prevents said chair from accumulating liquid, said canopy extending forwardly and downwardly from said hooks when said canopy is in said open position wherein said canopy encloses said backrest, said seat, and a top portion of said plurality of legs when said canopy is in said open position;

a motor being mechanically coupled with said covering and being configured for positioning said covering from said closed position to said open position when actuated, said motor being mechanically coupled to said plurality of ribs of said frame, said motor being actuated to pivotally position said ribs from said closed position to said open position, said motor being positioned within said lower cross member;

a control circuit being electrically coupled to said motor, said control circuit being positioned within said lower cross member;

an actuator being electrically coupled with said control circuit, said actuator being actuated to start or stop said motor;

a transceiver being electrically coupled to said control circuit, said transceiver being configured for wirelessly communicating with a personal electronic device, wherein the personal electronic device is in wireless communication with said actuator, said transceiver being positioned within said lower cross member; and a battery being electrically coupled to said control circuit, said battery being positioned within said lower cross member, said battery being rechargeable, said battery having a charging port configured for removably receiving a charging cord of a power supply, said charging port being positioned on an exterior surface of said lower cross member.

* * * * *